US007070055B2

(12) United States Patent
Lechanoine et al.

(10) Patent No.: US 7,070,055 B2
(45) Date of Patent: Jul. 4, 2006

(54) PACKAGING FOR TWO OR MORE ITEMS

(75) Inventors: Marc Lechanoine, Paris (FR); Olivier Tkacz, Saulzoir (FR); Philippe Strebelle, Compiegne (FR)

(73) Assignee: L'Oreal S.A., Paris (FR)

( * ) Notice: Subject to any disclaimer, the term of this patent is extended or adjusted under 35 U.S.C. 154(b) by 268 days.

(21) Appl. No.: 10/141,170

(22) Filed: May 9, 2002

(65) Prior Publication Data

US 2003/0066766 A1 Apr. 10, 2003

(30) Foreign Application Priority Data

May 9, 2001 (FR) ..... 01 06126

(51) Int. Cl.
*B65D 71/00* (2006.01)
*B65D 69/00* (2006.01)
*B65D 25/54* (2006.01)

(52) U.S. Cl. ..... 206/581; 206/223; 206/229; 206/779; 206/823

(58) Field of Classification Search ..... 206/730–735, 206/216, 581, 823, 223, 385, 462, 471, 497, 206/784, 472, 527, 229, 775–779, 525, 526, 206/525.1; 220/501, 23.87, 23.8, 661, 676, 220/737, 23.83; 229/162, 120.02, 103.2, 229/120.01, 120.37, 162.1, 167, 168, 93
See application file for complete search history.

(56) References Cited

U.S. PATENT DOCUMENTS

| | | | | |
|---|---|---|---|---|
| 1,103,880 | A * | 7/1914 | Johnson | 206/730 |
| 1,217,375 | A * | 2/1917 | Warren | 206/733 |
| 2,280,935 | A * | 4/1942 | Stevens, Jr. | 206/733 |
| 3,217,923 | A * | 11/1965 | Price | 220/663 |
| 3,241,738 | A * | 3/1966 | Freiman | 206/223 |
| 3,369,660 | A | 2/1968 | Hartman | |
| 3,586,163 | A | 6/1971 | Loehrer | |
| 4,377,234 | A * | 3/1983 | Kaplan | 206/432 |
| 4,840,275 | A * | 6/1989 | Faiola et al. | 206/462 |
| 4,842,141 | A | 6/1989 | Segal | |
| 5,407,076 | A * | 4/1995 | Sabet | 206/581 |
| 5,575,384 | A * | 11/1996 | Saye | 206/232 |
| 5,741,570 | A * | 4/1998 | Seufert | 428/167 |
| D394,808 | S * | 6/1998 | Mansau | D9/432 |
| 6,089,369 | A | 7/2000 | Markey | |
| 6,719,139 | B1 * | 4/2004 | Foos et al. | 206/462 |
| 2002/0088730 | A1 * | 7/2002 | Galomb | 206/459.5 |

FOREIGN PATENT DOCUMENTS

| | | |
|---|---|---|
| GB | 2 074 124 | 10/1981 |
| JP | JU-B3047737 | 2/1998 |
| JP | JU-3076774 | 1/2001 |

* cited by examiner

*Primary Examiner*—Mickey Yu
*Assistant Examiner*—J. Gregory Pickett
(74) *Attorney, Agent, or Firm*—Finnegan, Henderson, Farabow, Garrett & Dunner, LLP

(57) ABSTRACT

A packaging for two or more items includes a sleeve defining a first compartment configured to accommodate a first item. One or more ends of the sleeve is open or configured to be opened. The sleeve is formed by bringing together two longitudinal edge portions of a sheet and fixing the two longitudinal edge portions together. The packaging also includes a second compartment substantially external to the first compartment. The second compartment is configured to accommodate a second item and includes an opening that opens into the first compartment. The packaging may be associated with at least the first item and the second item so as to form an assembly.

187 Claims, 4 Drawing Sheets

Fig. 2A
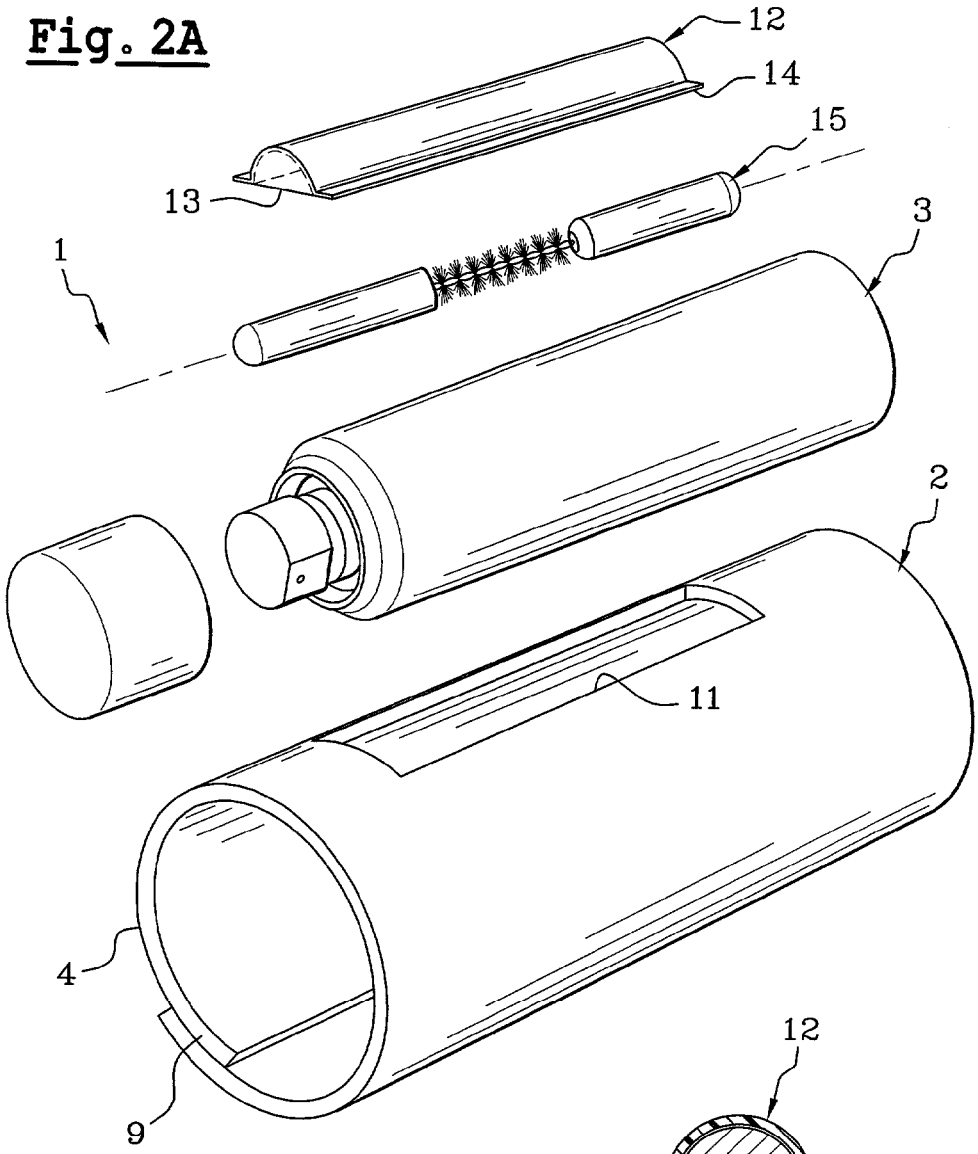
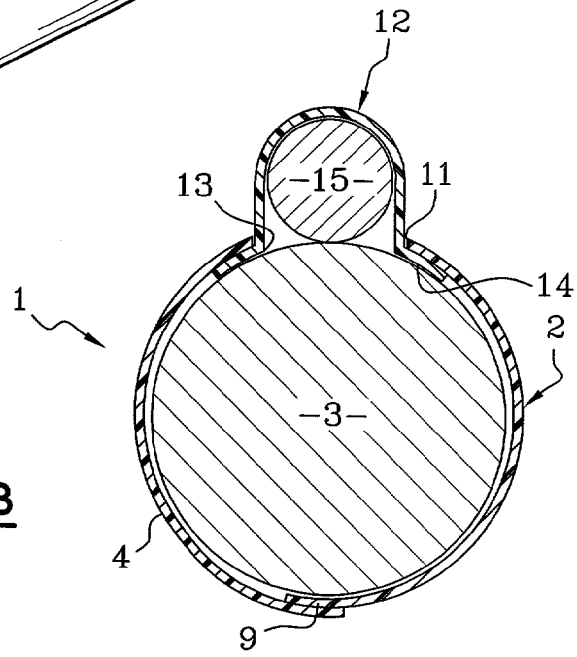
Fig. 2B

Fig. 3A
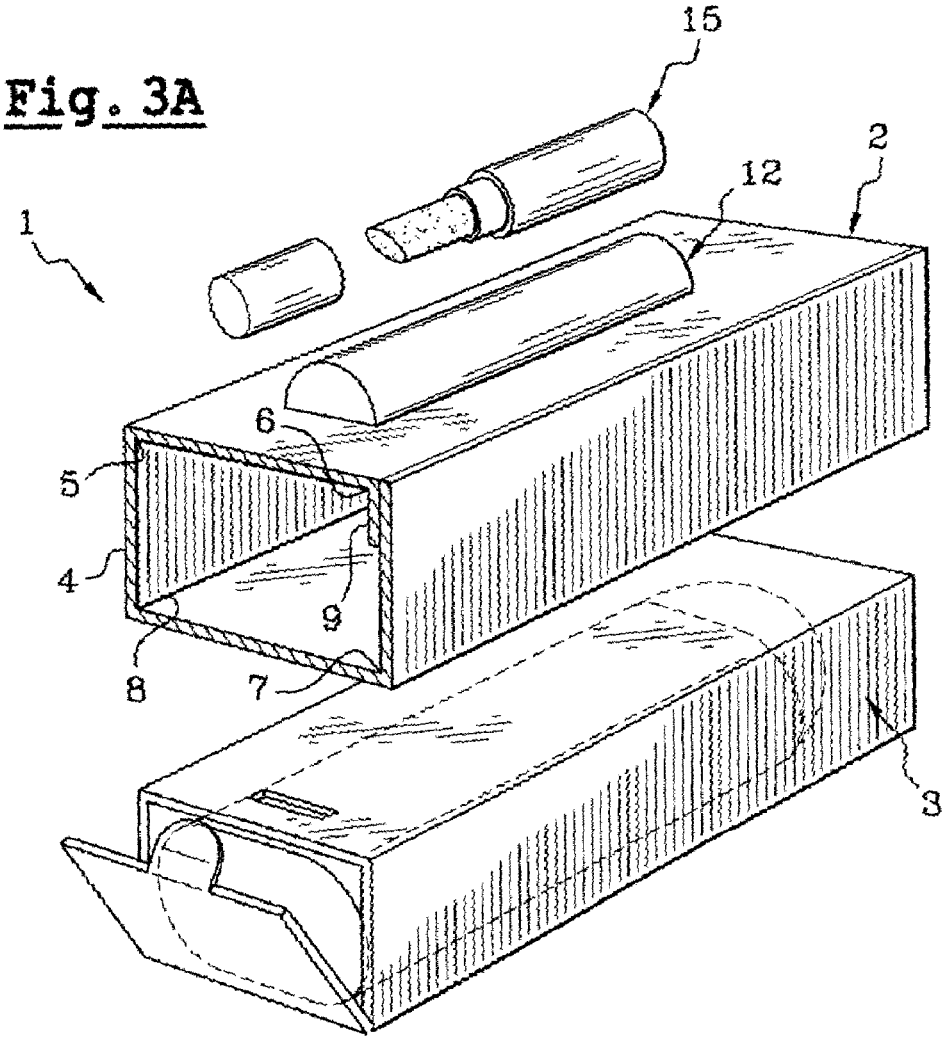
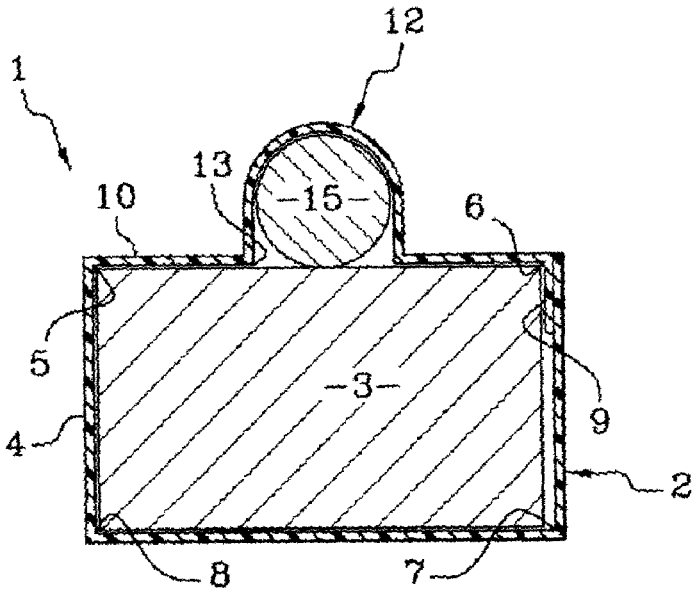
Fig. 3B

PACKAGING FOR TWO OR MORE ITEMS

The present invention relates to a packaging for at least two items and an assembly including a combination of the packaging and the items. The packaging may be used to provide a grouped presentation of the items. For example, the items may be cosmetic items such as hygiene products, hair-dyeing products, hair-styling products, make-up products, and/or care products.

In some product promotions, a free promotional item (e.g., a sampler) is associated with a main item, possibly differing from the free item. For example, in the field of cosmetics a generally small can of hairspray may be associated with a hair dyeing product. In yet another example, a make-up product may associated with a hair spray product.

Packaging two or more items together in a simple and economic manner is sometimes challenging. Of course, each item may be packaged separately in separate packages specific to each item (e.g., cardboard boxes), but sometimes the separate packaging of items is unacceptable.

U.S. Pat. No. 3,369,660 describes packaging for a pair of shoes. The packaging includes a parallelepiped-shaped box, divided in two along its diagonal by a double partition. A first shoe is arranged above the partition so that part of the first shoe extends into a first housing via an opening formed in a first large face of the box. A second shoe is arranged under the partition so that part of the second shoe extends into a second housing via an opening formed in a second large face of the box, opposite the first large face. The configuration of the partitions and a number of other features may make such a shoe packaging difficult to assemble and render it difficult to insert a pair of shoes into the packaging.

In one other known packaging arrangement, two items may be grouped together by using a sleeve of heat-shrink material wrapped around the items. This type of packaging may not have a pleasant appearance. Furthermore, it is not always simple and economical to implement.

The present invention may fully or partially obviate one or more limitations of the related art. For example, the present invention may provide a packaging configuration that is relatively simple and economical as compared to very complex packing arrangements. It should be understood that the invention could be practiced without performing one or more of the objects and/or advantages described herein. Other objects and advantages of the invention may become apparent from the description which follows.

The present invention is described by referring to a number of aspects and embodiments. It should be understood that these aspects and embodiments are exemplary and that the invention could be practiced without necessarily having all of the features of the aspects and embodiments described herein.

As embodied and broadly described herein, one aspect of the invention relates to packaging for two or more items. The packaging may include a sleeve defining a first compartment configured to accommodate a first item. One or more ends of the sleeve may open or configured to be opened. The sleeve may be formed by bringing together two longitudinal edge portions of a sheet and fixing the two longitudinal edge portions together. The packaging may also include a second compartment substantially external to the first compartment. The second compartment may be configured to accommodate a second item and include an opening that opens into the first compartment.

In another aspect, the packaging is configured to enable the first item to be arranged wholly on one side of the opening and the second item to be arranged wholly on the other side of the opening. In one embodiment of such an arrangement, the first item does not extend substantially into the second compartment and the second item does not extend substantially into the first compartment. Such an embodiment differs from the packaging described in above-mentioned U.S. Pat. No. 3,369,660 where imaginary planes defined by openings in a box intersect the middle portions of shoes extending through the openings and the box contains only part of a first shoe above a diagonal partition and only part of a shoe below the partition.

In another embodiment, the first compartment contains the entirety of the cross-section of the first item over at least part of the height thereof, and the second compartment contains the entirety of the cross-section of the second item over at least part of the height thereof. Such an embodiment is optionally very easy to produce and to assemble. Furthermore, it may possibly be configured to allow the item contained in the second compartment to be held in place by the item contained in the first compartment.

In yet another aspect, the second compartment has a smaller volume than the first compartment.

In still another aspect, at least a portion of the sleeve may define an internal cross-section configured to correspond with an external cross-section of the first item. As used herein the expression "an internal cross-section configured to correspond with an external cross-section of a first item" may relate to an internal cross-section having a shape and/or size similar to that of an external cross-section of the first item. In one embodiment where a sleeve has such an internal cross-section, it may be possible to insert the first item into the sleeve via an open end of the sleeve so that the sleeve holds the item by friction and/or light gripping. For example, such insertion may take place after inserting the second item into the second compartment.

The sleeve may be of a height that is shorter than that of the first item, and when the sleeve is configured to grip the first item, the first item may be gripped only over part of its height. In another embodiment, the height of the sleeve may be similar to that of the first item.

In one embodiment, the sleeve may have a structural configuration enabling opening and possibly also closing of one or more opposite ends of the sleeve. For example, the sleeve may include one or more end flaps or any other alternative closure movable between a closed position and an opening position. With such structure, if the sleeve does not grip the external surface of the first item, it may be possible to close one or more ends of the sleeve.

In another embodiment, an element, such as a heat-sealed membrane, may be used to close off the opening.

In another aspect, the packaging may be configured to enable the grouped presentation of the items In one aspect, the sheet may be flexible. For example, the sheet may be flexible enough to be bent and/or folded.

There are many possible shapes for the sleeve. In one embodiment, the sleeve may be approximately cylindrical-shaped. For example, such a sleeve may be easy to manufacture and facilitate fitting items it is intended to contain. It may also be simple and economical to implement. Its appearance may be compatible with the demands of various markets such as the cosmetics market.

The sleeve may or may not have symmetry of revolution.

The cross-section of the sleeve may have any shape. In one example, the cross-section may lack any corners (e.g., be substantially circular). In another example, the cross-section may be polygonal (e.g., substantially rectangular). In yet another example, the cross-section may be substantially quadrangular. Exemplary shapes for the cross-section of the sleeve include substantially circular, substantially elliptical, substantially rectangular, substantially square, substantially hexagonal, substantially octagonal cross, or any other shape.

In a further aspect, at least a portion of the sleeve may have a curvature and the opening may define an imaginary surface having substantially the same curvature.

In yet another aspect, the sleeve may have at least one substantially planar face and the opening may extend at least partially in a plane defined by the at least one substantially planar face.

In still another aspect, the packaging may be configured so that the second item is held in place inside the second compartment by the first item. In one embodiment with such an arrangement, the packaging may have a simplified design.

In a further aspect, the second compartment may be removably associated with the first compartment. In one embodiment of such an arrangement, the second compartment may be defined by a package (e.g., a thermoformed shell) used to package the second item alone when the second item is offered for sale individually. In another embodiment, a sleeve used to package the first item when the first item is offered for sale individually, may be modified for use in the packaging of the present invention by cutting out an aperture having an appropriate shape and size. When these two embodiments using the individual packages for the first and second items are combined, the combined packaging may be formed without a mold or any excessive equipment other than those used to manufacture the individual packages.

Another aspect relates to the packaging being configured so that the second compartment is held in place with respect to the first compartment by the first item when the first item is placed in the first compartment.

In an even further aspect, the sleeve is coupled to an element defining the second compartment. For example, the sleeve may be coupled removably to the element or fixed to the element through the use of adhesive or fusion welding, for example. In one embodiment, the sleeve and the element are formed from sheets having a differing thickness and/or differing materials.

Yet another aspect includes a portion of the sleeve optionally defining an aperture passing therethrough, wherein the second compartment is defined by an element comprising a rim, and wherein the rim rests against an interior of the portion of the sleeve defining the aperture.

The two compartments may be defined by portions made of identical or different materials. For example, the sleeve may be formed of a flexible material to facilitate possible folding used to form the sleeve, while the portion defining the second compartment may be defined by a more rigid material, such as a material that may be thermoformed to define the second compartment. In one embodiment, the material used to define the first compartment and the material used to define the second compartment may have a different thickness, resulting in a different flexibility (and a corresponding different rigidity).

In another aspect, the second compartment may be formed by thermoforming a material. Such a material may be a substantially transparent material. The thermoformed material may be chosen from vinyls, styrenes, methacrylics, cellulose materials, and polycarbonates. The vinyls may be chosen from polyvinyl chlorides (PVCs) and copolymers of polyvinyl chlorides.

In yet another aspect, the sleeve and a portion of the packaging defining the second compartment may be defined by a single piece of material. For example, the second compartment may be formed by deforming the sheet using heat. In one embodiment, after hot-deformation of the sheet to form the second compartment, the sheet may possibly be folded and then welded or bonded along its two longitudinal edge portions, for example via a rim adjacent to one of the longitudinal edges.

In another embodiment, wherein the material forming the sheet is rigid enough to be thermoformed, the sheet may have a configuration making it easier for the flexible sheet to be folded. For example, the sheet may have zones of weakness in the form of perforated dotted lines and/or sheet markings formed using a tool to weaken the material along fold lines.

In a further aspect, the sheet forming the sleeve may be made of a thermoplastic. For example, the material forming the sleeve may be substantially transparent. In one embodiment, the sheet may be chosen from polyvinyl chloride (PVC) materials.

In an alternative embodiment, the sleeve may be substantially cylindrical and open at its opposite ends. Such a sleeve may have a polygonal (e.g., quadrangular) cross section, or have no corners (e.g., circular or elliptical).

In one other aspect, the longitudinal edge portions of the sheet may be fixed together by bonding or welding, such as thermal welding or high-frequency welding. For example, the two longitudinal edge portions may overlap one another so that one rests on top of the other.

In another embodiment, the longitudinal edge portions of the sheet may be brought together by folding the sheet along a plurality of fold lines.

Still another aspect of the present invention relates to an assembly including the packaging in combination with a first item in the first compartment and a second item in the second compartment.

In one embodiment of the assembly, the first item may be arranged wholly on one side of the opening and the second item may be arranged wholly on the other side of the opening. For example, the first item and/or the second item may be a cosmetic product (e.g., a make-up product). When each item is a cosmetic product, the items may have either identical cosmetic uses or differing cosmetic uses. In one embodiment, the first item may be a hair dye kit (e.g., including hair dye and/or components that may be mixed to form a hair dye, wherein the dye/components are optionally contained in a box).

Although certain features are described in connection with items that are cosmetic products, it should be appreciated that the present invention could be used for packaging one or more items that are not cosmetic products.

In one embodiment, the first item includes a box and at least one sub-item in the box. In another embodiment, the second item includes a container containing at least one substance.

In yet another aspect, the first item may have a volume greater than a volume of the second item.

In a further aspect, when at least a portion of the sleeve is substantially transparent, the first item may be visible through the substantially transparent portion.

In an even further aspect, when the second compartment is defined by a substantially transparent portion, the second item may be visible through the substantially transparent portion.

One further aspect relates to at least a portion of the sleeve optionally defining an internal cross-section corresponding with an external cross-section of the first item. For example, the second item may be held in place inside the second compartment by the first item.

One more aspect relates to the second compartment optionally being removably associated with the first compartment, wherein the second compartment may be held in place with respect to the first compartment by the first item in the first compartment.

In another aspect, the assembly may be configured to enable the first item in the first compartment and the second item in the second compartment to contact one another. For example, the assembly may be arranged so that contact between the items is maintained. Alternatively, one or more of the items may be able to move at least slightly in the packaging so that the items may be out of contact in certain orientations of the packaging. The contact may occur via one or each of the items passing at least partially through the opening.

Aside from the structural arrangements set forth above, the invention could include a number of other arrangements, such as those explained hereinafter. It is to be understood that both the foregoing description and the following description are exemplary.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1A is an exploded perspective view of one embodiment of a packaging assembly according to the invention;

FIG. 2A is an exploded perspective view of another embodiment of a packaging assembly;

FIG. 2B is a cross-section view of the embodiment of FIG. 2A when the assembly is in an assembled form;

FIG. 3A is an exploded perspective view of yet another embodiment of a packaging assembly;

FIG. 3B is a cross-section view of the embodiment of FIG. 3A when the assembly is in an assembled form.

Reference will now be made in detail to some exemplary embodiments of the invention, as illustrated in the accompanying drawings. Wherever possible, the same reference numbers are used in the drawings and the description to refer to the same or similar parts.

Figure 1A:
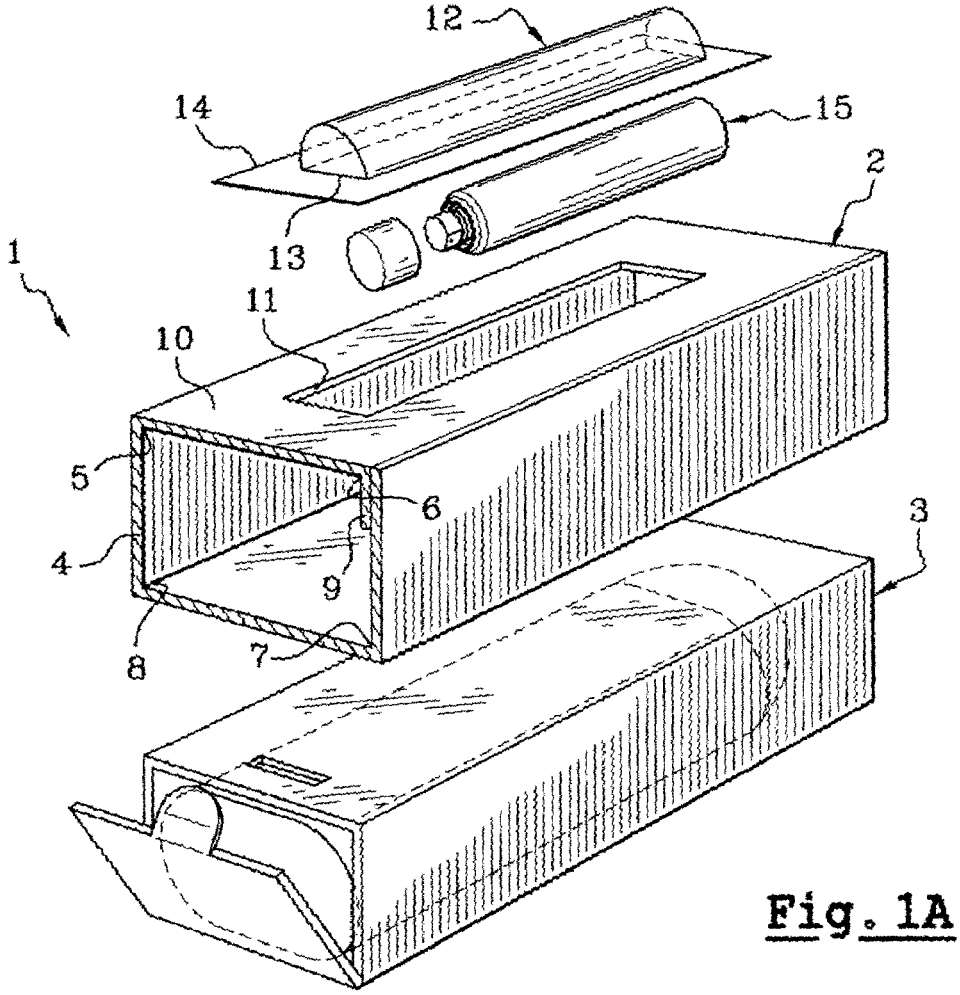
FIG. 1B is a cross-section view of the embodiment of FIG. 1A when the assembly is in an assembled form.
Figure 1B:
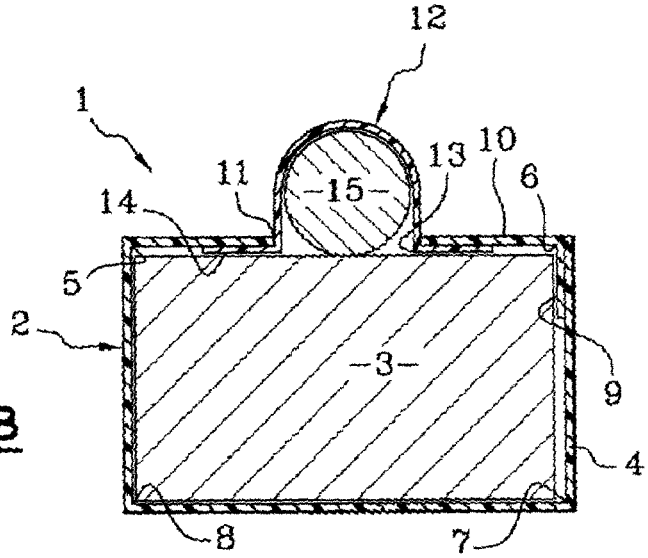

FIGS. 1A and 1B show an embodiment of an assembly 1 including a sleeve 2 defining a first compartment for a first item 3 and an element 12 defining a second compartment for a second item 15. The sleeve 2 has a parallelepiped shape and is open at both ends. The sleeve 2 is produced from a rectangular PVC sheet 4, folded along four longitudinal lines 5–8, and welded or bonded (e.g., using an acetate adhesive) along two longitudinal edge portions via a rim 9 adjacent to the fold line 6. For example, the thickness of the sheet 4 is approximately 220 μm.

The sleeve 2 formed from the sheet 4 forms an interior compartment configured to accommodate the item 3. In the embodiment of FIGS. 1A and 1B, the item 3 includes a box having external dimensions similar to the internal dimensions of the sleeve 2. For example, the box may contain one of more parts of a hair dye kit.

An aperture 11 passes through a large face 10 of the sleeve 2 and is oriented longitudinally to the sleeve 2.

In the embodiment of FIGS. 1A and 1B, the element 12 is in the form of a thermoformed shell defining a semi-cylinder and a longitudinal opening 13. The opening is surrounded by a rim 14 formed in a plane of the opening 13 having an external cross-section arger than the cross-section of the aperture 11. The element 12 is intended to accommodate the second item 15 that is to be packaged with the first item 3. In the example shown in FIGS. 1A and 1B, the second item 15 comprises a hair spray dispenser in the form of an aerosol container including a dispensing valve actuator.

The element 12 may be made of any material that can be thermoformed. For example, the element may be made of a PVC thicker than the one used for making the sleeve. The thickness of the PVC used for the shell may be approximately 500 μm.

The assembly 1 may be arranged together after forming the sleeve 2 and the element 12. To make the assembly 1, the element 12 containing the item 15 may be mounted on the sleeve 2 via one of its open ends and positioned so that the rim 14 contacts a portion of the sleeve 2 defining the aperture 11. After that, the item 3 may be slipped into the sleeve 2, thus immobilizing the item 15 in the thermoformed shell 12.

A label (not depicted) having an adhesive face may be applied to the assembly 1 so that one end of the label is positioned on the sleeve 2 and the other end of the label is positioned on one of the end flaps of the box 3. The label may provide an indicator for identifying when the assembly 1 has been opened. Furthermore, the label may include an identification code, such as a bar code. The label may also be arranged to conceal an identification code (e.g., a bar code) affixed directly to the first item 3 and intended to identify the first item 3 when the item 3 is sold separately from the second item 15.

FIGS. 2A and 2B shown an embodiment of the assembly 1 similar to that of the embodiment of FIGS. 1A and 1B except for the overall shape of the packaging and the items it contains. According to this embodiment, the sleeve 2 forms a cylinder that is substantially symmetric about its axis. The first item 3 that the sleeve 2 is intended to contain is a hair spray dispenser. The item 15 contained in the element 12 is a mascara device. For example, the mascara device may include a container containing mascara and an applicator (e.g., a brush or comb) for applying mascara to the eyelashes, the eyebrows, and/or other hair.

The assembly 1 of FIGS. 2A and 2B may be formed in a manner similar to that used for forming the assembly of FIGS. 1A and 1B except that the sleeve may be formed without folding.

FIGS. 3A and 3B show an embodiment of an assembly similar to that of FIGS. 1A and 1B except that the packaging is formed as a single piece of material, such as PVC.

Figure 3C:
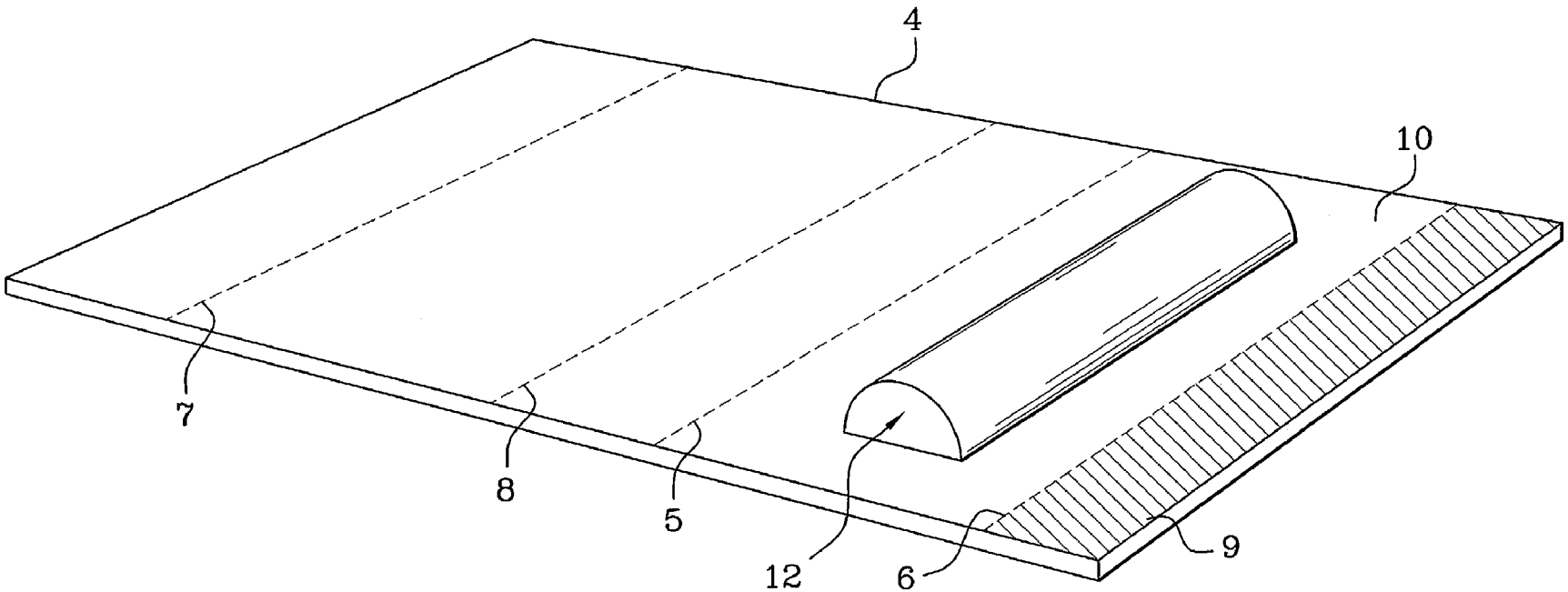
FIG. 3C is a perspective view of a sheet that may be used to form a packaging of the assembly of FIGS. 3A and 3B.

FIG. 3C shows an example of a sheet 4 that could be used to form the packaging shown in FIGS. 3A and 3B. The sheet 4 is rectangular and has lines of weakness defining the fold lines 5–8. One of the large faces 10 of the sheet 4 is deformed under the action of heat so as to define an element 12 in the form of a semi-cylindrical shell. To form the packaging, the sheet 4 is folded along the lines 5–8 and bonded along two of its longitudinal edge portions via the rim 9. Thereafter, the first and second items 3 and 15 may be positioned inside the packaging in a manner similar to that used for the embodiment of FIGS. 1A and 1B.

In the embodiment of FIGS. 3A and 3B, the item 3 contained in the sleeve 2 is a hair dyeing kit. The other item 15 contained in the element 12 is a lipstick dispenser.

It will be apparent to those skilled in the art that various modifications and variations can be made to the structure of the present. Thus, it should be understood that the invention is not limited to the examples discussed in the specification. Rather, the present invention is intended to cover modifications and variations.

What is claimed is:

1. An assembly comprising:

a packaging for at least two items, the packaging comprising, a sleeve, at least one end of the sleeve being one of open and configured to be opened, the sleeve being formed by bringing together two longitudinal edge portions of a sheet and fixing the two longitudinal edge portions together, wherein the sleeve defines a first compartment configured to accommodate a first item, and a second compartment substantially external to the first compartment, the second compartment being configured to accommodate a second item and comprising an opening that opens into the first compartment, wherein the packaging is configured to enable the first item to be arranged wholly on one side of the opening and the second item to be arranged wholly on the other side of the opening;

a first item in the first compartment; and a second item in the second compartment, wherein the first item is arranged wholly on one side of the opening and the second item is arranged wholly on the other side of the opening, wherein the second item comprises a container containing at least one substance, and wherein at least one of the first item and the second item is a cosmetic product.

2. The assembly of claim 1, wherein the sheet is flexible.

3. The assembly of claim 1, wherein at least a portion of the sleeve defines an internal cross-section configured to correspond with an external cross-section of the first item.

4. The assembly of claim 1, wherein the first compartment is approximately cylindrical-shaped.

5. The assembly of claim 1, wherein the second compartment has a volume smaller a volume of the first compartment.

6. The assembly of claim 5, wherein at least a portion of the sleeve has a curvature and wherein the opening defines an imaginary surface having substantially the same curvature as said at least a portion of the sleeve.

7. The assembly of claim 6, wherein the sleeve has a cross-section lacking any corners.

8. The assembly of claim 7, wherein the sleeve has a substantially circular cross-section.

9. The assembly of claim 5, wherein the sleeve has at least one substantially planar face and wherein the opening extends at least partially in a plane defined by the at least one substantially planar face.

10. The assembly of claim 9, wherein the sleeve has a polygonal cross-section.

11. The assembly of claim 10, wherein sleeve has a substantially rectangular cross-section.

12. The assembly of claim 1, wherein the packaging is configured so that the second item is held in place inside the second compartment by the first item.

13. The assembly of claim 1, wherein the second compartment is removably associated with the first compartment.

14. The assembly of claim 13, wherein the packaging is configured so that the second compartment is held in place with respect to the first compartment by the first item when the first item is placed in the first compartment.

15. The assembly of claim 13, wherein a portion of the sleeve defines an aperture passing therethrough, wherein the second compartment is defined by an element comprising a rim, and wherein the rim rests against an interior of the portion of the sleeve defining the aperture.

16. The assembly of claim 1, wherein a portion of the sleeve defines an aperture passing therethrough, wherein the second compartment is defined by an element comprising a rim, and wherein the rim rests against an interior of the portion of the sleeve defining the aperture.

17. The assembly of claim 1, wherein the sleeve is made of a first material and wherein a portion of the packaging defining the second compartment is made of a second material identical to the first material.

18. The assembly of claim 1, wherein the sleeve is made of a first material and wherein a portion of the packaging defining the second compartment is made of a second material differing from the first material.

19. The assembly of claim 1, wherein the second compartment comprises thermoformed material.

20. The assembly of claim 19, wherein the thermoformed material is substantially transparent.

21. The assembly of claim 19, wherein the thermoformed material is chosen from vinyls, styrenes, methacrylics, cellulose materials, and polycarbonates.

22. The assembly of claim 21, wherein the vinyls are chosen from polyvinyl chlorides and copolymers of polyvinyl chlorides.

23. The assembly of claim 1, wherein the second compartment is defined by a portion formed of substantially transparent material.

24. The assembly of claim 1, wherein the sleeve and a portion of the packaging defining the second compartment are defined by a single piece of material.

25. The assembly of claim 24, wherein the second compartment is formed by deforming the sheet using heat.

26. The assembly of claim 1, wherein the sheet is a sheet of thermoplastic material.

27. The assembly of claim 26, wherein the thermoplastic material is substantially transparent.

28. The assembly of claim 26, wherein the thermoplastic material is chosen from polyvinyl chlorides.

29. The assembly of claim 1, wherein the sleeve is formed of substantially transparent material.

30. The assembly of claim 1, wherein the sleeve is substantially cylindrical and open at its opposite ends.

31. The assembly of claim 1, wherein the sleeve has a polygonal cross-section.

32. The assembly of claim 31, wherein the sleeve has a substantially quadrangular cross-section.

33. The assembly of claim 30, wherein the sleeve has a cross-section lacking any corners.

34. The assembly of claim 33, wherein the cross-section of the sleeve is substantially circular.

35. The assembly of claim 1, wherein the longitudinal edge portions of the sheet are fixed together by one of bonding and welding.

36. The assembly of claim 1, wherein the longitudinal edge portions are brought together by folding the sheet along a plurality of fold lines.

37. The assembly of claim 1, wherein the sleeve is coupled to an element defining the second compartment.

38. The assembly of claim 37, wherein the sleeve is coupled removably to the element.

39. The assembly of claim 37, wherein the sleeve and the element are formed from sheets having at least one of a differing thickness and differing materials.

40. The assembly of claim 1, wherein the two longitudinal edge portions overlap one another.

41. The assembly of claim 1, wherein each of the first item and the second item comprises a cosmetic product.

42. The assembly of claim 41, wherein the first item has a cosmetic use differing from a cosmetic use of the second item.

43. The assembly of claim 41, wherein the first item has a cosmetic use identical to a cosmetic use of the second item.

44. The assembly of claim 1, wherein at least a portion of the sleeve is substantially transparent and wherein the first item is visible through said at least a portion of the sleeve.

45. The assembly of claim 1, wherein the second compartment is defined by a substantially transparent portion, and wherein the second item is visible through said substantially transparent portion.

46. The assembly of claim 1, wherein the first item comprises a box and at least one sub-item in the box.

47. The assembly of claim 1, wherein said at least one of the first item and the second item comprises a make-up product.

48. The assembly of claim 1, wherein the first item comprises a hair dye kit.

49. An assembly comprising:

a packaging for at least two items, the packaging comprising, a sleeve, at least one end of the sleeve being one of open and configured to be opened, the sleeve being formed by bringing together two longitudinal edge portions of a sheet and fixing the two longitudinal edge portions together, wherein the sleeve defines a first compartment configured to accommodate a first item; and a second compartment substantially external to the first compartment, the second compartment being configured to accommodate a second item and comprising an opening that opens into the first compartment, wherein the second compartment has a smaller volume than the first compartment;

a first item in the first compartment; and a second item in the second compartment, wherein the second item comprises a container containing at least one substance.

50. The assembly of claim 49, wherein the sheet is flexible.

51. The assembly of claim 49, wherein at least a portion of the sleeve defines an internal cross-section corresponding with an external cross-section of the first item.

52. The assembly of claim 49, wherein the first compartment is approximately cylindrical-shaped.

53. The assembly of claim 49, wherein at least a portion of the sleeve has a curvature and wherein the opening defines an imaginary surface having substantially the same curvature as said at least a portion of the sleeve.

54. The assembly of claim 53, wherein the sleeve has a cross-section lacking any corners.

55. The assembly of claim 54, wherein the sleeve has a substantially circular cross-section.

56. The assembly of claim 49, wherein the sleeve has at least one substantially planar face and wherein the opening extends at least partially in a plane defined by the at least one substantially planar face.

57. The assembly of claim 56, wherein the sleeve has a polygonal cross-section.

58. The assembly of claim 57, wherein sleeve has a substantially rectangular cross-section.

59. The assembly of claim 49, wherein the packaging is configured so that the second item is held in place inside the second compartment by the first item.

60. The assembly of claim 49, wherein the second compartment is removably associated with the first compartment.

61. The assembly of claim 60, wherein the packaging is configured so that the second compartment is held in place with respect to the first compartment by the first item when the first item is placed in the first compartment.

62. The assembly of claim 60, wherein a portion of the sleeve defines an aperture passing therethrough, wherein the second compartment is defined by an element comprising a rim, and wherein the rim rests against an interior of the portion of the sleeve defining the aperture.

63. The assembly of claim 49, wherein a portion of the sleeve defines an aperture passing therethrough, wherein the second compartment is defined by an element comprising a rim, and wherein the rim rests against an interior of the portion of the sleeve defining the aperture.

64. The assembly of claim 49, wherein the sleeve is made of a first material and wherein a portion of the packaging defining the second compartment is made a second material identical to the first material.

65. The assembly of claim 49, wherein the sleeve is made of a first material and wherein a portion of the packaging defining the second compartment is made a second material differing from the first material.

66. The assembly of claim 49, wherein the second compartment comprises thermoformed material.

67. The assembly of claim 66, wherein the thermoformed material is substantially transparent.

68. The assembly of claim 66, wherein the thermoformed material is chosen from vinyls, styrenes, methacrylics, cellulose materials, and polycarbonates.

69. The assembly of claim 68, wherein the vinyls are chosen from polyvinyl chlorides and copolymers of polyvinyl chlorides.

70. The assembly of claim 49, wherein the second compartment is defined by a portion formed of substantially transparent material.

71. The assembly of claim 49, wherein the sleeve and a portion of the packaging defining the second compartment are defined by a single piece of material.

72. The assembly of claim 71, wherein the second compartment is formed by deforming the sheet using heat.

73. The assembly of claim 49, wherein the sheet is a sheet of thermoplastic material.

74. The assembly of claim 73, wherein the thermoplastic material is substantially transparent.

75. The assembly of claim 73, wherein the thermoplastic material is chosen from polyvinyl chlorides.

76. The assembly of claim 49, wherein the sleeve is formed of substantially transparent material.

77. The assembly of claim 49, wherein the sleeve is substantially cylindrical and open at its opposite ends.

78. The assembly of claim 49, wherein the sleeve has a polygonal cross-section.

79. The assembly of claim 78, wherein the sleeve has a substantially quadrangular cross-section.

80. The assembly of claim 77, wherein the sleeve has a cross-section lacking any corners.

81. The assembly of claim 80, wherein the cross-section of the sleeve is substantially circular.

82. The assembly of claim 49, wherein the longitudinal edge portions of the sheet are fixed together by one of bonding and welding.

83. The assembly of claim 49, wherein the longitudinal edge portions are brought together by folding the sheet along a plurality of fold lines.

84. The assembly of claim 49, wherein the sleeve is coupled to an element defining the second compartment.

85. The assembly of claim 84, wherein the sleeve is coupled removably to the element.

86. The assembly of claim 84, wherein the sleeve and the element are formed from sheets having at least one of a differing thickness and differing materials.

87. The assembly of claim 49, wherein the two longitudinal edge portions overlap one another.

88. The assembly of claim 49, wherein at least one of the first item and the second item comprises a cosmetic product.

89. The assembly of claim 88, wherein each of the first item and the second item comprises a cosmetic product.

90. The assembly of claim 89, wherein the first item has a cosmetic use differing from a cosmetic use of the second item.

91. The assembly of claim 89, wherein the first item has a cosmetic use identical to a cosmetic use of the second item.

92. The assembly of claim 49, wherein at least a portion of the sleeve is substantially transparent and wherein the first item is visible through said at least a portion of the sleeve.

93. The assembly of claim 49, wherein the second compartment is defined by a substantially transparent portion, and wherein the second item is visible through said substantially transparent portion.

94. The assembly of claim 49, wherein at least a portion of the sleeve defines an internal cross-section corresponding with an external cross-section of the first item.

95. The assembly of claim 49, wherein the second item is held in place inside the second compartment by the first item.

96. The assembly of claim 49, wherein the second compartment is removably associated with the first compartment, and wherein the second compartment is held in place with respect to the first compartment by the first item in the first compartment.

97. The assembly of claim 49, wherein the first item comprises a box and at least one sub-item in the box.

98. The assembly of claim 88, wherein said at least one of the first item and the second item comprises a make-up product.

99. The assembly of claim 49, wherein the first item comprises a hair dye kit.

100. The assembly of claim 49, wherein the first item has a volume greater than a volume of the second item.

101. An assembly comprising:

a packaging for at least two items, the packaging comprising, a sleeve, at least one end of the sleeve being one of open and configured to be opened, the sleeve being formed by bringing together two longitudinal edge portions of a sheet and fixing the two longitudinal edge portions together, wherein the sleeve defines a first compartment configured to accommodate a first item, wherein at least a portion of the sleeve defines an internal cross-section configured to correspond with an external cross-section of the first item, and a second compartment substantially external to the first compartment, the second compartment being configured to accommodate a second item and comprising an opening that opens into the first compartment;

a first item in the first compartment; and a second item in the second compartment, wherein the second item comprises a container containing at least one substance, and wherein at least one of the first item and the second item is a cosmetic product.

102. The assembly of claim 101, wherein the sheet is flexible.

103. The assembly of claim 101, wherein the first compartment is approximately cylindrical-shaped.

104. The assembly of claim 101, wherein the second compartment has a volume smaller a volume of the first compartment.

105. The assembly of claim 104, wherein at least a portion of the sleeve has a curvature and wherein the opening defines an imaginary surface having substantially the same curvature as said at least a portion of the sleeve.

106. The assembly of claim 105, wherein the sleeve has a cross-section lacking any corners.

107. The assembly of claim 106, wherein the sleeve has a substantially circular cross-section.

108. The assembly of claim 104, wherein the sleeve has at least one substantially planar face and wherein the opening extends at least partially in a plane defined by the at least one substantially planar face.

109. The assembly of claim 108, wherein the sleeve has a polygonal cross-section.

110. The assembly of claim 109, wherein sleeve has a substantially rectangular cross-section.

111. The assembly of claim 101, wherein the packaging assembly is configured so that the second item is held in place inside the second compartment by the first item.

112. The assembly of claim 101, wherein the second compartment is removably associated with the first compartment.

113. The assembly of claim 112, wherein the packaging assembly is configured so that the second compartment is held in place with respect to the first compartment by the first item when the first item is placed in the first compartment.

114. The assembly of claim 112, wherein a portion of the sleeve defines an aperture passing therethrough, wherein the second compartment is defined by an element comprising a rim, and wherein the rim rests against an interior of the portion of the sleeve defining the aperture.

115. The assembly of claim 101, wherein a portion of the sleeve defines an aperture passing therethrough, wherein the second compartment is defined by an element comprising a rim, and wherein the rim rests against an interior of the portion of the sleeve defining the aperture.

116. The assembly of claim 101, wherein the sleeve is made of a first material and wherein a portion of the packaging assembly defining the second compartment is made a second material identical to the first material.

117. The assembly of claim 101, wherein the sleeve is made of a first material and wherein a portion of the packaging assembly defining the second compartment is made a second material differing from the first material.

118. The assembly of claim 101, wherein the second compartment comprises thermoformed material.

119. The assembly of claim 118, wherein the thermoformed material is substantially transparent.

120. The assembly of claim 118, wherein the thermoformed material is chosen from vinyls, styrenes, methacrylics, cellulose materials, and polycarbonates.

121. The assembly of claim 120, wherein the vinyls are chosen from polyvinyl chlorides and copolymers of polyvinyl chlorides.

122. The assembly of claim 101, wherein the second compartment is defined by a portion formed of substantially transparent material.

123. The assembly of claim 101, wherein the sleeve and a portion of The packaging assembly defining the second compartment are defined by a single piece of material.

124. The assembly of claim 123, wherein the second compartment is formed by deforming the sheet using heat.

125. The assembly of claim 101, wherein the sheet is a sheet of thermoplastic material.

126. The assembly of claim 125, wherein the thermoplastic material is substantially transparent.

127. The assembly of claim 125, wherein the thermoplastic material is chosen from polyvinyl chlorides.

128. The assembly of claim 101, wherein the sleeve is formed of substantially transparent material.

129. The assembly of claim 101, wherein the sleeve is substantially cylindrical and open at its opposite ends.

130. The assembly of claim 101, wherein the sleeve has a polygonal cross-section.

131. The assembly of claim 130, wherein the sleeve has a substantially quadrangular cross-section.

132. The assembly of claim 129, wherein the sleeve has a cross-section lacking any corners.

133. The assembly of claim 132, wherein the cross-section of the sleeve is substantially circular.

134. The assembly of claim 101, wherein the longitudinal edge portions of the sheet are fixed together by one of bonding and welding.

135. The assembly of claim 101, wherein the longitudinal edge portions are brought together by folding the sheet along a plurality of fold lines.

136. The assembly of claim 101, wherein the sleeve is coupled to an element defining the second compartment.

137. The assembly of claim 136, wherein the sleeve is coupled removably to the element.

138. The assembly of claim 136, wherein the sleeve and the element are formed from sheets having at least one of a differing thickness and differing materials.

139. The assembly of claim 101, wherein the two longitudinal edge portions overlap one another.

140. The assembly of claim 101, wherein each of the first item and the second item comprises a cosmetic product.

141. The assembly of claim 140, wherein the first item has a cosmetic use differing from a cosmetic use of the second item.

142. The assembly of claim 140, wherein the first item has a cosmetic use identical to a cosmetic use of the second item.

143. The assembly of claim 101, wherein at least a portion of the sleeve is substantially transparent and wherein the first item is visible through said at least a portion of the sleeve.

144. The assembly of claim 101, wherein the second compartment is defined by a substantially transparent portion, and wherein the second item is visible through said substantially transparent portion.

145. The assembly of claim 101, wherein the second item is held in place inside the second compartment by the first item.

146. The assembly of claim 101, wherein the second compartment is removably associated with the first compartment, and wherein the second compartment is held in place with respect to the first compartment by the first item in the first compartment.

147. The assembly of claim 101, wherein the first item comprises a box and at least one sub-item in the box.

148. The assembly of claim 101, wherein said at least one of the first item and the second item comprises a make-up product.

149. The assembly of claim 101, wherein the first item comprises a hair dye kit.

150. An assembly comprising:

a packaging, wherein the packaging comprises a sleeve, at least one end of the sleeve being one of open and configured to be opened, the sleeve being formed by bringing together two longitudinal edge portions of a sheet and fixing the two longitudinal edge portions together, wherein the sleeve defines a first compartment, and a second compartment substantially external to the first compartment, the second compartment comprising an opening that opens into the first compartment;

a first item in the first compartment; and a second item in the second compartment, wherein the second item comprises a container containing at least one substance, and wherein at least one of the first item and the second item comprises a cosmetic product.

151. The assembly of claim 150, wherein said at least one of the first item and the second item comprises a make-up product.

152. The assembly of claim 150, wherein each of the first item and the second item comprises a cosmetic product.

153. The assembly of claim 152, wherein the first item has a cosmetic use differing from a cosmetic use of the second item.

154. The assembly of claim 152, wherein the first item has a cosmetic use identical to a cosmetic use of the second item.

155. The assembly of claim 150, wherein at least a portion of the sleeve is substantially transparent and wherein the first item is visible through said at least a portion of the sleeve.

156. The assembly of claim 150, wherein the second compartment is defined by a substantially transparent portion, and wherein the second item is visible through said substantially transparent portion.

157. The assembly of claim 150, wherein at least the second item comprises a cosmetic product, and wherein the second item is held in place inside the second compartment by the first item.

158. The assembly of claim 150, wherein the second compartment is removably associated with the first compartment, and wherein the second compartment is held in place with respect to the first compartment by the first item in the first compartment.

159. The assembly of claim 150, wherein the first item comprises a box and at least one sub-item in the box.

160. The assembly of claim 150, wherein each of the first item and the second item comprises a make-up product.

161. The assembly of claim 150, wherein the first item comprises a hair dye kit.

162. The assembly of claim 150, wherein at least the second item comprises a cosmetic product, and wherein the first item has a volume greater than a volume of the second item.

163. An assembly comprising:

a packaging, wherein the packaging comprises a sleeve, at least one end of the sleeve being one of open and configured to be opened, the sleeve being formed by bringing together two longitudinal edge portions of a sheet and fixing the two longitudinal edge portions together, wherein the sleeve defines a first compartment, and a second compartment substantially external to the first compartment, the second compartment comprising an opening that opens into the first compartment;

a first item in the first compartment; and a second item in the second compartment, wherein the assembly is configured to enable the first item in the first compartment and the second item in the second compartment to contact one another, wherein the second item comprises a container containing at least one substance, and wherein at least one of the first item and the second item is a cosmetic product.

164. The assembly of claim 163, wherein each of the first item and the second item comprises a cosmetic product.

165. The assembly of claim 164, wherein the first item has a cosmetic use differing from a cosmetic use of the second item.

166. The assembly of claim 164, wherein the first item has a cosmetic use identical to a cosmetic use of the second item.

167. The assembly of claim 163, wherein at least a portion of the sleeve is substantially transparent and wherein the first item is visible through said at least a portion of the sleeve.

168. The assembly of claim 163, wherein the second compartment is defined by a substantially transparent portion, and wherein the second item is visible through said substantially transparent portion.

169. The assembly of claim 163, wherein at least a portion of the sleeve defines an internal cross-section corresponding with an external cross-section of the first item.

170. The assembly of claim 163, wherein the second item is held in place inside the second compartment by the first item.

171. The assembly of claim 163, wherein the second compartment is removably associated with the first compartment, and wherein the second compartment is held in place with respect to the first compartment by the first item in the first compartment.

172. The assembly of claim 163, wherein the first item comprises a box and at least one sub-item in the box.

173. The assembly of claim 163, wherein said at least one of the first item and the second item comprises a make-up product.

174. The assembly of claim 163, wherein the first item comprises a hair dye kit.

175. The assembly of claim 163, wherein the first item has a volume greater than a volume of the second item.

176. The packaging of claim 1, wherein the cosmetic product is selected from at least one of hygiene products, hair drying products, hair styling products, make-up products, and care products.

177. An assembly comprising:

a first item;

a second item; and a packaging comprising, a sleeve, at least one end of the sleeve being one of open and configured to be opened, the sleeve being formed by bringing together two longitudinal edge portions of a sheet and fixing the two longitudinal edge portions together, wherein the sleeve defines a first compartment accommodating the first item, and a second compartment substantially external to the first compartment, the second compartment accommodating the second item and comprising an opening that opens into the first compartment, wherein the packaging is configured to enable the first item to be arranged wholly on one side of the opening and the second item to be arranged wholly on the other side of the opening, and wherein each of the first compartment and the second compartment is configured to accommodate a respective substantially non-planar item, wherein at least one of the first item and the second item comprises a container containing at least one substance.

178. The assembly of claim 177, wherein the first compartment is configured to accommodate a substantially non-planar item without significantly deforming the first compartment.

179. The assembly of claim 177, wherein the second compartment is configured to accommodate a substantially non-planar item without significantly deforming the second compartment.

180. An assembly comprising:

a first item;

a second item; and a packaging for at least two items, the packaging comprising, a sleeve, at least one end of the sleeve being one of open and configured to be opened, the sleeve being formed by bringing together two longitudinal edge portions of a sheet and fixing the two longitudinal edge portions together, wherein the sleeve defines a first compartment accommodating the first item; and a second compartment substantially external to the first compartment, the second compartment accommodating the second item and comprising an opening that opens into the first compartment, wherein the packaging is configured to enable the first item to be arranged wholly on one side of the opening and the second item to be arranged wholly on the other side of the opening, and wherein the first compartment comprises at least one open end configured to introduce the first item therein, the opening being distinct from the at least one open end, and the opening and the at least one open end being defined in different planes, wherein at least one of the first item and the second item comprises a container containing at least one substance.

181. The assembly of claim 1, wherein the two longitudinal edge portions are located on opposite sides of the sheet.

182. The packaging of claim 49, wherein the two longitudinal edge portions are located on opposite sides of the sheet.

183. The assembly of claim 101, wherein the two longitudinal edge portions are located on opposite sides of the sheet.

184. The assembly of claim 150, wherein the two longitudinal edge portions are located on opposite sides of the sheet.

185. The assembly of claim 163, wherein the two longitudinal edge portions are located on opposite sides of the sheet.

186. The assembly of claim 177, wherein the two longitudinal edge portions are located on opposite sides of the sheet.

187. The packaging of claim 180, wherein the two longitudinal edge portions are located on opposite sides of the sheet.

* * * * *